US006250124B1

(12) United States Patent
Satoh

(10) Patent No.: US 6,250,124 B1
(45) Date of Patent: Jun. 26, 2001

(54) STEEL PIPE BENDING APPARATUS AND METHOD

(76) Inventor: Toru Satoh, 1593-12, Okazu-cho, Izumi-ku, Yokohama-shi, Kanagawa-ken 245-0003 (JP)

( * ) Notice: Subject to any disclaimer, the term of this patent is extended or adjusted under 35 U.S.C. 154(b) by 0 days.

(21) Appl. No.: 09/558,298

(22) Filed: Apr. 25, 2000

(30) Foreign Application Priority Data

Feb. 28, 2000 (JP) ..... 12-051208

(51) Int. Cl.[7] ..... B21K 29/00; B21D 37/16
(52) U.S. Cl. ..... 72/128; 72/342.1
(58) Field of Search ..... 72/128, 149, 152, 72/342.1, 342.5, 369

(56) References Cited

U.S. PATENT DOCUMENTS

| | | | | |
|---|---|---|---|---|
| Re. 30,639 | * | 6/1981 | Hofstede et al. | 72/8 |
| 4,122,697 | * | 10/1978 | Hanyo et al. | 72/128 |
| 4,195,506 | * | 4/1980 | Kawanami et al. | 72/128 |
| 4,412,442 | * | 11/1983 | Kawanami et al. | 72/128 |
| 4,596,128 | * | 6/1986 | Ringersma et al. | 72/128 |

FOREIGN PATENT DOCUMENTS

| | | |
|---|---|---|
| P8-294729A | 11/1996 | (JP) . |
| P12-15350A | 1/2000 | (JP) . |

* cited by examiner

*Primary Examiner*—Rodney A. Butler
(74) *Attorney, Agent, or Firm*—James Creighton Wray; Meera P. Narasimhan

(57) ABSTRACT

The present invention is carried out to supply a small sized and lightweight steel pipe bending apparatus so as to bring to construction sites, so as to keep thinning a thickness of the pipe at lower level and so as to obtain the pipe with a desired bending radius. The following apparatus realizes above-mentioned objectives of the present invention. A pipe bending apparatus comprises; a heating means to heat a steel pipe circularly around an center axis of the pipe, a cooling means to cool the heated portion of the pipe circularly around the center axis of the pipe, a tensile force applying means to apply the tensile force on points of application which are located in the opposite directions from the circular heated portion, a variable controlling means to control the tensile force variably, a transfer means to transfer the heated portion and the steel pipe relatively to the heating means and the cooling means in the direction of the axis of the steel pipe and a controlling means to control a velocity of the transfer.

4 Claims, 11 Drawing Sheets

STEEL PIPE BENDING APPARATUS AND METHOD

BACKGROUND OF THE INVENTION

1. Field of the Invention

The present invention relates to an apparatus and a method of steel pipe bending.

2. Brief Description of the Related Art

FIG. 10 shows a conventional steel bending apparatus. A bending procedure according to this apparatus is carried out as follows:

(1) As shown in FIG. 10 a steel pipe 51 to be bent is placed between support rollers 52 and rear end of the pipe facing a pusher 54 is held by a tail-stock 53. The front end of the pipe is held by an arm clamp 57 attached to a pivotal arm 56 which revolve the front end of the steel pipe 51 around a pivot 55.

(2) Power is supplied to a heating coil 60 via a heating unit 62. Then as shown in FIG. 11, the steel pipe 51 is pushed through a pair of guide rollers 58 and 59 disposed right and left sides of the pipe by the pusher 54 in the direction of an axis of the steel pipe, is transferred toward heating coil 60 and is passed through the coil 60. In this way, the pushed steel pipe 51 is successively heated with induced current from the heating coil 60. Since the coil has a circular shape, the periphery of the steel pipe 51 is heated circularly around the axis of the pipe. As shown in FIG. 12, since the front side of the heated portion of the pipe is cooled successively by water 62 spouted from a plurality of holes h formed circularly on a circular channel 60*a* of the coil 60 so as to obtain cooled circular portion c of the steel pipe 51, only portion t having a width W, of the steel pipe 51, virtually remains in a heated state. The locally heated potion t successively transfers toward the rear end of the pipe as the steel pipe 51 transfers forward. The temperature of the locally heated portion t is kept over a crystallization temperature of the pipe. In the case of a carbon steel pipe, for example, the heated zone having width W in the direction of the steel pipe axis is kept between 760° C. to 900° C. The front end of the steel pipe 51 is transferred forward by a successive pushing force from the pusher 54, but since it is fixed by the arm clamp 57 attached to the pivotal arm 56, the steel pipe is forced to bend successively at the locally heated portion t.

However, there are the following problems in the conventional steel pipe bending apparatus.

(1) Since enough rigidity is necessary to cope with a bending moment of the steel pipe and with an applied restraining force to the steel pipe via the pivotal arm, a massive and huge pipe bending apparatus is required. Therefore, because of the inferior portability of the apparatus, a large lot of pipes have to be bent at bending plants situated far from construction sites. Which is inevitably accompanied with the following drawbacks.

① At first, straight pipes are transported to a pipe bending plant and bent pipes are transported to construction sites by trucks or ships. However, bent pipes occupy more voluminous space, namely, higher transportation costs are inevitable.

② It is difficult to adjust pipe bending schedules flexibly according to modified schedules or designs or additional orders which often occur at sites such as plants and pipelines construction sites etc.

(2) According to the conventional method, since a compression force is imposed in the direction of the axis of the steel pipe due to the restraining force to the steel pipe moving forward via the pivotal arm, thinning a thickness of the pipe is prevented to a certain extent, but which is not satisfactory yet. In order to compensate such thinning thickness of the pipe, a one gage thicker pipe compared with a straight pipe to be connected with the bent pipe, is employed as the pipe for bending.

SUMMARY OF THE INVENTION

The present invention is carried out in view of the above-mentioned technical background to provide a steel pipe bending apparatus and a method having an excellent portability, having a good performance to minimize the thinning the thickness of the pipe during the bending procedure and having a flexible control on the bending radius.

The present invention provides the following pipe bending apparatuses.

(1) An apparatus of steel pipe bending comprises; a heating means to heat the steel pipe circularly around a center axis of the pipe, a cooling means to cool the heated portion of the pipe circularly around the center axis of the pipe, a tensile force applying means to apply the tensile force on points of application which are located in the opposite directions from the circularly heated portion, a variable controlling means to control the tensile force variably, a transfer means to transfer relatively the steel pipe and the heating means and the cooling means in a direction of the axis of the steel pipe and a controlling means to control the relative transfer velocity (Hereinafter referred as "the first apparatus").

(2) An apparatus of steel pipe bending comprises; a heating means to heat the steel pipe circularly around an center axis of the pipe, a cooling means to cool the heated portion of the pipe circularly around the center axis of the pipe, a tensile force applying means to apply the tensile force on points of application which are located in the opposite directions from the circularly heated portion, a variable controlling means to control the tensile force variably, a transfer means to transfer relatively the steel pipe and the heating means and the cooling means in a direction of the axis of the steel pipe, a controlling means to control the relative transfer velocity and a scale to measure bent values stepwise according to a predetermined bending schedule (Hereinafter referred as "the second apparatus").

The present invention provides the following pipe bending methods.

(1) A method of steel pipe bending comprises; forming a locally heated circular portion around a center axis of the steel pipe, relatively transferring the locally heated portion and the steel pipe in a direction of the center axis of the steel pipe and controlling the relative transfer velocity of the heated portion and the steel pipe during a bending procedure by applying a tensile force between two points of application which are located in the opposite directions from the heated portion along an eccentric axis of the steel pipe (Herein after referred as "the first method").

(2) A method of steel pipe bending comprises; forming a locally heated circular portion around a center axis of the steel pipe, relatively transferring the locally heated portion and the steel pipe in a direction of the center axis of the steel pipe, measuring actual bent values stepwise during a successive bending procedure according to a bending schedule where bent values are predetermined stepwise and controlling the relative transfer velocity of the heated portion and the steel pipe during the bending procedure by applying a tensile force between two points of application which are located in the opposite directions from the heated portion along an eccentric axis of the steel pipe according to a difference between the predetermined bent value and the actual bent value (Hereinafter referred as "the second method").

DETAILED DESCRIPTION OF THE PREFERRED EMBODIMENTS

Hereinafter the detailed examples according to the present invention are described with reference to embodiments.

Embodiment 1

Figure 1:
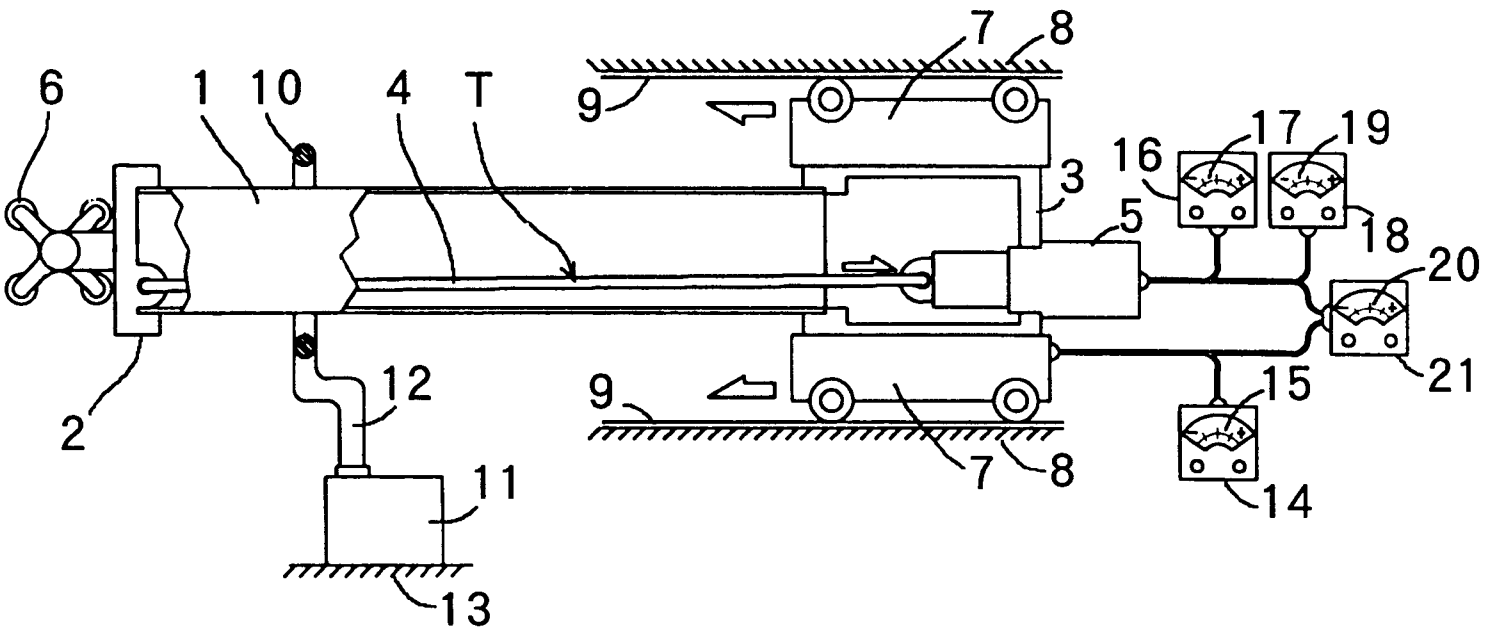
FIG. 1 is a plan view with a partial cutout of a pipe bending apparatus in the embodiment 1.
Figure 2:
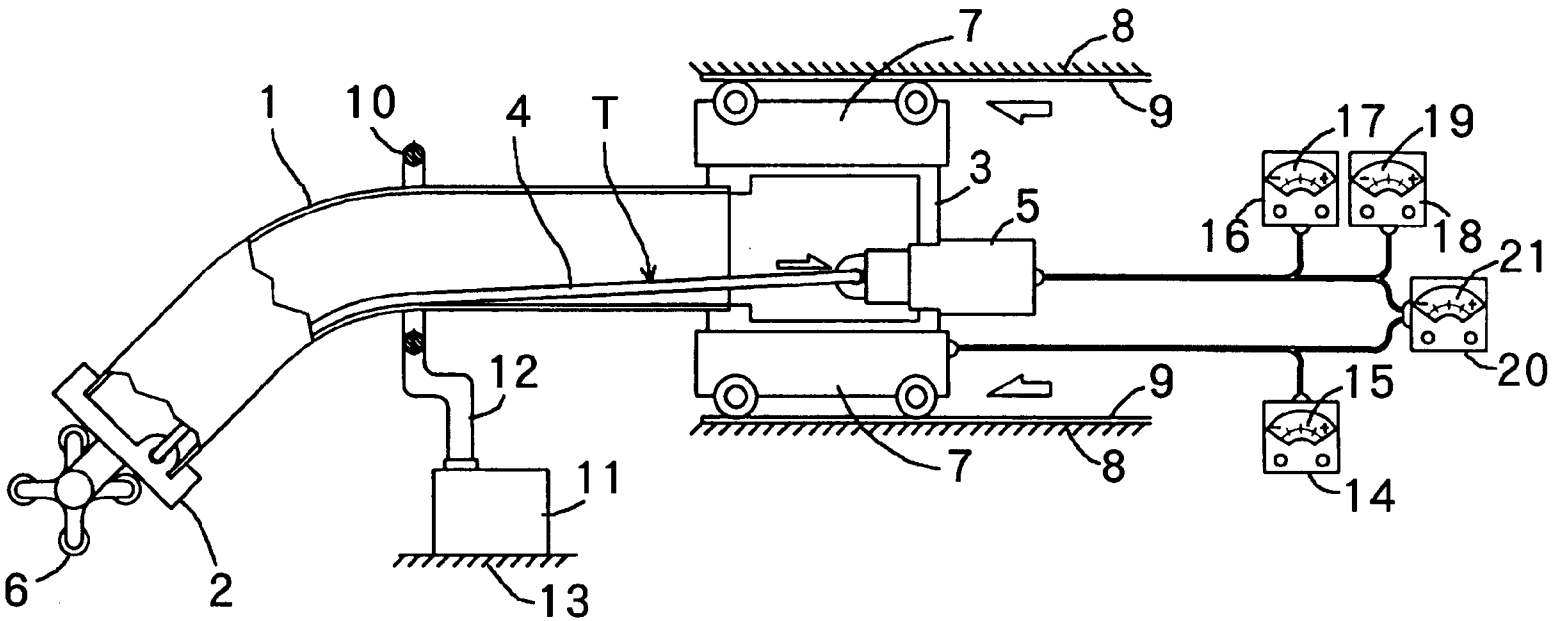
FIG. 2 shows a pipe bending movement of the pipe bending apparatus in the embodiment 1.

FIG. 1 and FIG. 2 show an embodiment of the first apparatus. FIG. 1 is a plan view with a partial cutout of a pipe bending apparatus in the embodiment 1 and FIG. 2 shows a pipe bending movement of the pipe bending apparatus. An embodiment of the first method is realized by employing the pipe bending apparatus according to this embodiment.

In these figures a numeric character 1 represents a steel pipe, to front and rear ends of which a front cramping plate 2 and a rear cramping plate 3 are applied respectively. An alphabetic character T represents a tensile force application unit that applies a tensile force between the plate 2 and the plate 3. The unit T is constituted of a chain 4 and a hydraulic jack 5 which supplies the tensile force to the chain. A front end of the chain 4 is fixed to the front cramping plate 2 and the hydraulic jack 5 is fixed to the rear cramping plate 3.

The fixed front end of the chain 4 to the front cramping plate 2 and the fixed end of the hydraulic jack 5 to the rear cramping plate are aligned in an eccentric axis line on a plane which extends along an axis line of the steel pipe 1. The both fixed ends are application points of the tensile force applied to the chain 4 by the hydraulic jack 5.

Figure 12:
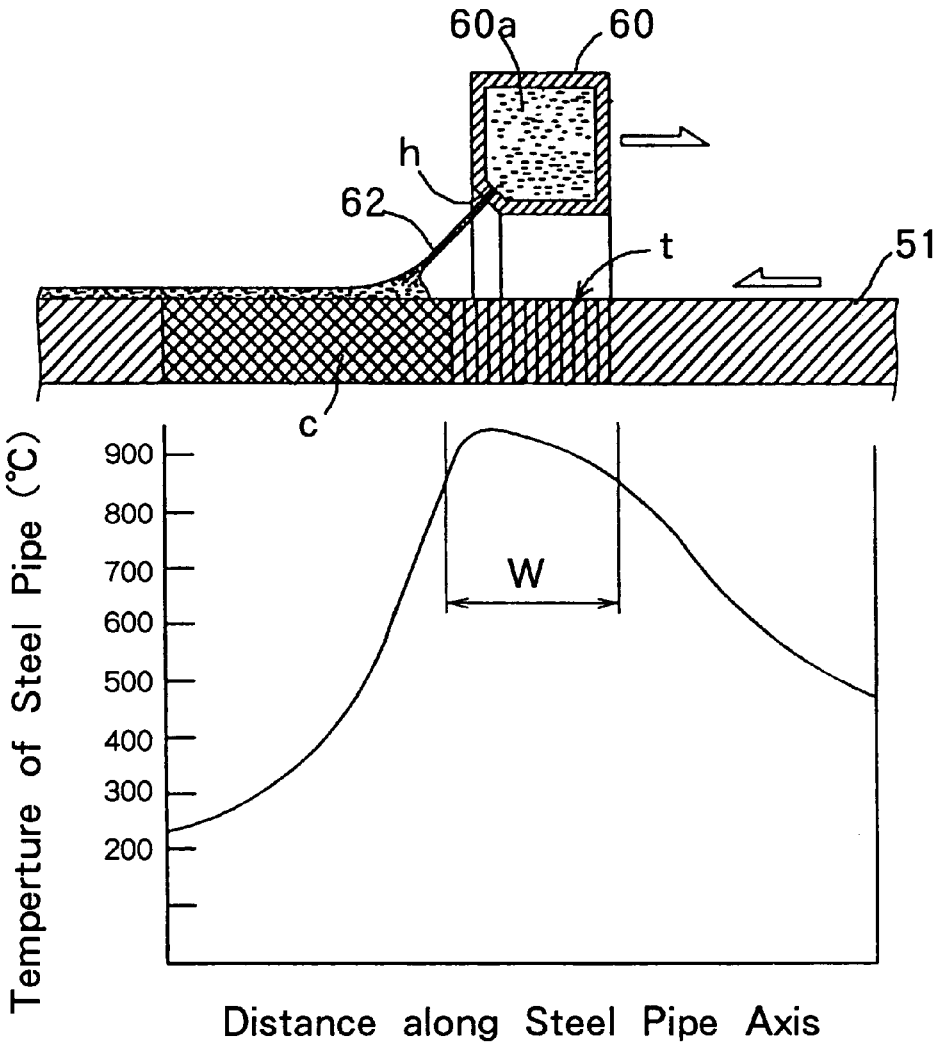
FIG.12 (PRIOR ART)
FIG. 12 shows an enlarged cross-sectional view of the heating coil in FIG. 10 and shows a temperature distribution curve in the vicinity of a heated portion along the axis of the steel pipe.

An adjustable wheel unit 6 which supports the weight of the steel pipe and moves a horizontal floor without restrictions is attached to the front cramping plate 2. A steel pipe transfer unit 7 in which the rear cramping plate 3 is built, transfers along rails 9 laid on supports 8 in the direction of the axis of the steel pipe 1. A numeric character 10 represents a heating coil to heat a periphery of the steel pipe 1 and a numeric character 11 represents a heating unit. Via a coil holder 12, the heating coil 10 is supported by a frame of the heating unit 11 which is fixed to a support 13. The detailed structure and functions of the heating coil are similar to the conventional one shown in FIG. 12.

A transfer velocity of the steel pipe transfer unit 7 is adjustable by a velocity regulator 14 for the steel pipe transfer with referring to a measured value from a velocity indicator 15 for the steel pipe transfer. The tensile force supplied from the hydraulic jack 5 to drag the chain is adjustable by a tensile force regulator 16 with referring to a measured value from a tensile force indicator 17.

The tensile force supplied from the hydraulic jack is adjustable by adjusting a drag velocity of the chain, since the tensile force and the drag velocity of the chain correlate with each other.

In this embodiment, the drag velocity of the chain derived from the hydraulic jack 5 is adjusted by a drag velocity regulator 18 with referring to a measured value from a tensile velocity indicator 19.

A ratio of the drag velocity of the chain 4 to a relative velocity of the locally heated portion t (See FIG. 12) and the steel pipe 1 is adjusted by a velocity ratio regulator 20 and its measured value is displayed on a velocity ratio indicator 21. Heated temperature of the steel pipe 1 by the heating coil 10 and temperature of cooing water 62 are controlled by controlling means (which are not shown in figures).

Herein after a steel pipe bending procedure is described according to the apparatus with the above-mentioned constitution.

The steel pipe 1 is transferred forward by driving the steel pipe transfer unit 7 and when the hydraulic jack 5 applies the tensile force to the chain 4, the steel pipe 1 is bent continuously at the locally heated portion t (see FIG. 12) which transfers backward successively receiving a compression force in the direction of the eccentric axis of the steel pipe, since the both fixed ends are aligned on the eccentric axis.

If the drag velocity of the chain 4 is increased (i.e. the tensile force is increased), a bent radius of the steel pipe can be decreased due to an increasing bent amount per unit time. On the other hand if the drag velocity of the chain 4 is decreased (i.e. the tensile force is decreased), the bent radius of the pipe can be increased due to a decreasing bent amount per unit time. If the transfer velocity of the steel pipe transfer unit 7 is decreased the bent radius of the pipe can be decreased due to the same reasons mentioned above.

Consequently, if a ratio V1/V2, where V1 is the drag velocity of the chain 4 and V2 is the transfer velocity of the steel pipe transfer unit 7, is increased, the bent radius is decreased, and vice versa.

As described in the embodiment 1, when a bending procedure of the steel pipe is executed by applying the tensile force to the two points of application aligned on the eccentric axis of the steel pipe 1, the bent radius of the steel pipe 1 can be controlled for example according to a bending curve depicted on a floor, since the above-mentioned tensile velocity (i.e. tensile force) and the relative velocity of the above-mentioned locally heated portion and the pipe can be controlled.

In the embodiment 1, during the bending procedure, thinning the thickness of the pipe is suppressed, since the steel pipe is compressed in the longitudinal direction by applying the tensile force between the two points of the application along the eccentric axis of the steel pipe.

In addition, in the embodiment 1, since the steel pipe can be bent by employing the tensile force application unit, it is possible to render the pipe bending apparatus smaller and lighter. It is not necessary to prepare a massive and heavy apparatus to cope with a huge bending moment as seen in the conventional pushers (to apply pressing force) and pivotal arms. Therefore the present invention enables the pipe bending apparatus to be portable and to be set up on construction sites more easily.

Embodiment 2

Figure 3:
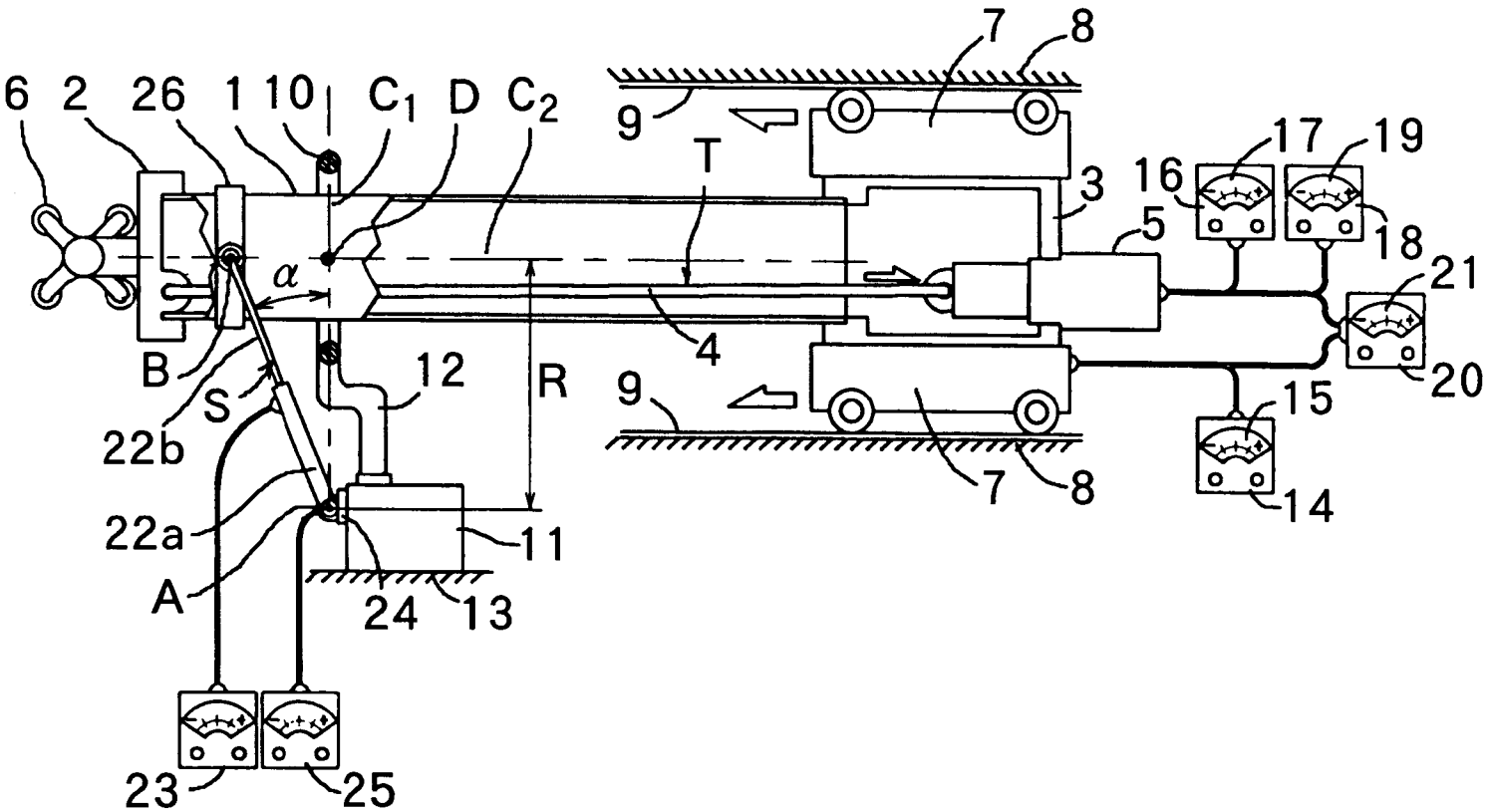
FIG. 3 is a plan view with a partial cutout of a pipe bending apparatus in the embodiment 2.
Figure 4:
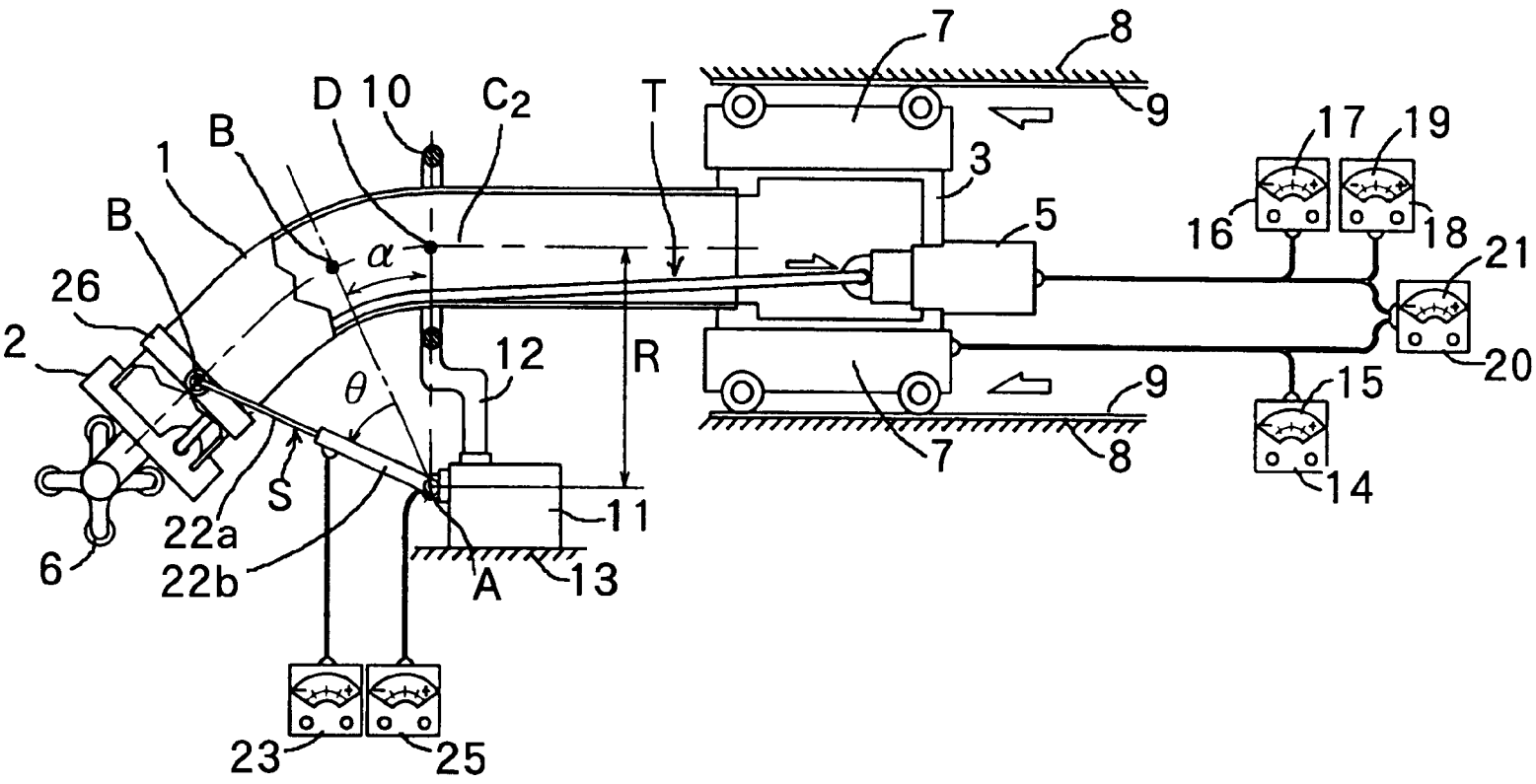
FIG. 4 shows a pipe bending movement of the pipe bending apparatus in the embodiment 2.

FIG. 3 and FIG. 4 show an embodiment of the second apparatus. An embodiment of the second method is realized by the steel pipe bending apparatus in the embodiment 2.

The steel pipe bending apparatus in the embodiment 2 employs the same apparatus in the embodiment 1 except having an additional measuring instrument S (hereinafter referred as "scale") which revolves according to the bending procedure of the steel pipe 1 and measures expanded value of an arm of the scale S in accordance with a revolved angle θ so as to determine bent value (hereinafter referred as "actual bent value") of the steel pipe 1, having an indicator 23 to display bent value, having a measuring instrument 24 to determine revolved angle of the scale S and having an indicator 25 to display revolved angle of the scale S.

Except instruments and indicators relevant to the scale S, the pipe bending apparatus has the same configuration as the embodiment 1. Since in FIG. 3 and FIG. 4, the same numeric or alphabetic characters are used to represent the same members or units as in FIG. 1, a detailed explanation of the apparatus is omitted.

The above-mentioned scale S is constituted of a cylinder 22*a* and a rod 22*b* built in the cylinder 22*a* so as to ensure expandable movement. One of the ends of the rod 22*b* is attached to a circular metal fitting 26 fixed to the front end of the steel pipe via a shaft B so as to revolve relatively to the fitting 26, while one of the ends of the cylinder 22*a* is attached to the frame of the heating unit 11 via a shaft A so as to revolve relatively to the frame.

The scale S revolves around the shaft A in accordance with the bending procedure of the steel pipe 1 by keeping its length constantly or variably, and the shaft B plays an outermost revolving point of the scale S.

An alphabetic character $C_1$ represents a center line in the diameter direction of the heating coil 10 perpendicular to an axis line $C_2$ of the steel pipe on a parallel plane to the floor. The revolving center A is aligned on the extended line of $C_1$. In FIG. 3 a cross point D where the axis line $C_2$ and the center line $C_1$ meet is a bending initiation point of the steel pipe 1.

As shown in FIG. 3 before bending, the scale S is arranged at a position with revolved angle α (hereinafter referred as "initial position") from the center line $C_1$ and at this stage the revolving point B is situated ahead of the above-mentioned cross point D on the axis line $C_2$. In this embodiment the angle α is set 20 degrees.

The above-mentioned actual bent value is expressed as an extended value of the scale S at a revolved angle θ of the scale when the length of the scale S at the initial position is set zero.

The extended value is displayed on the indicator 23. The revolved angle θ of the scale S is determined by the measuring instrument 24 and the determined value θ is displayed on the indicator 25.

By employing the steel bending apparatus with above-described constitution in the embodiment 2, a 90 degree bending procedure where the shaft A is set as the revolution point of the scale S and a bending radius R is set as a distance between the cross point D and the revolution point of the scale S (i.e. shaft A), is executed as follows.

(1) A bending schedule table as shown in Table 1 where the length of the scale S is exhibited in relation to the revolved angle θ of the scale S is prepared beforehand. The length of the scale S at the angle θ (1 to 90 degrees) in the Table 1 means the scheduled value expressed in mm when the value is set zero at the initial position.

TABLE 1

| Revolved angle (θ) | Scheduled bent value (mm) |
|---|---|
| 0° | 0 |
| 1° | 0 |
| 2° | 0 |
| 3° | 0 |
| 4° | 0 |
| 5° | 0 |
| . | . |
| . | . |
| 90° | 0 |

(2) In the same way as in the embodiment 1, the steel pipe 1 is successively bent by driving the steel pipe transfer unit 7 so as to transfer the steel pipe forward and applying the tensile force to the chain 4 from the hydraulic jack 5 with referring to the Table 1. As shown in in FIG. 4 the steel pipe 1 is continuously bent at the heating portion t which successively transfers backward reecieving applied compression force in the direction of the eccentric axis line of the pipe.

(3) During the bending procedure, if the actual bent values displayed on the indicator 23 are, for example, values in Table 2, the above-mentioned tensile velocity V1 from the hydraulic jack 5 and the transfer velocity V2 of the steel pipe transfer unit 7 are controlled as that the actual bent values attain the same values as scheduled ones.

TABLE 2

| Revolved angle (θ) | Scheduled bent value (mm) | Actual bent value (mm) |
|---|---|---|
| 0° | 0 | 0 |
| 1° | 0 | +1 |
| 2° | 0 | −1 |
| 3° | 0 | +1 |
| 4° | 0 | −1 |
| 5° | 0 | +1 |
| . | . | . |
| . | . | . |
| 90° | 0 | 0 |

Since the actual bent value, for example, +1 means that the actual bending amount is less than the scheduled one, the adjustment is made by increasing the above-mentioned tensile velocity V1, decreasing the transfer velocity V2 or increasing the ratio (V1/V2). When the actual bent value shows −1, the opposite controlling measure is taken.

Figure 5:
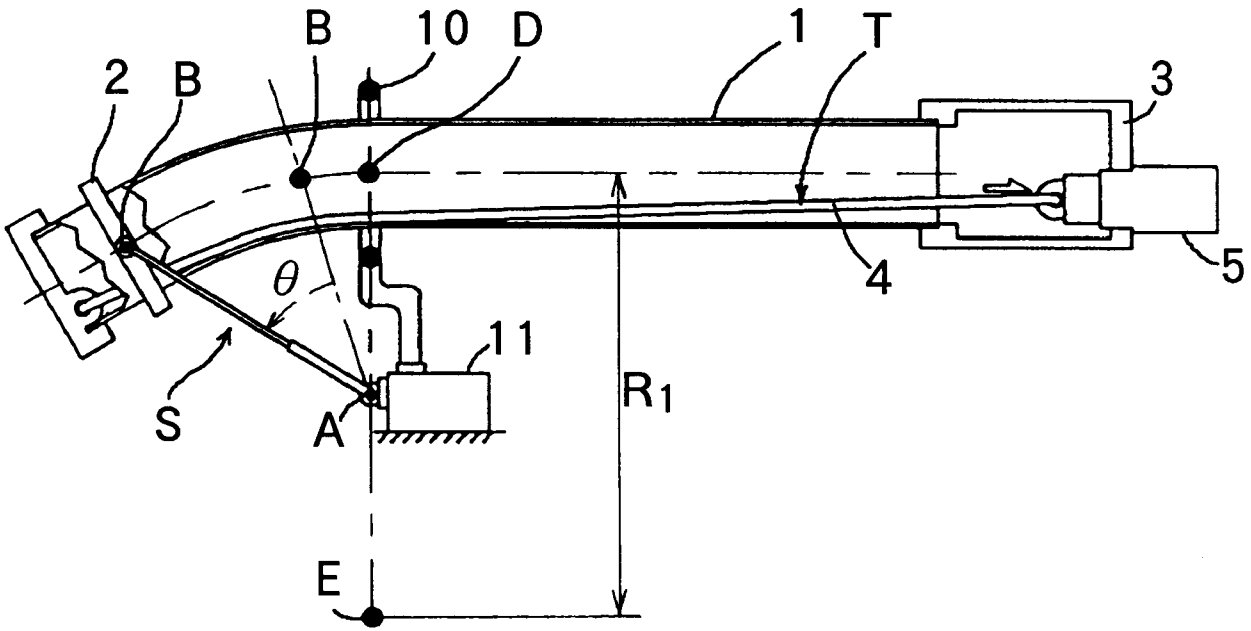
FIG. 5 is a plan view of an essential part of the pipe bending apparatus in the embodiment 2.

In the bending procedure depicted in FIG. 3 and FIG. 4, the center of the bending radius R is set at the revolving center A of the scale S. However, the bending radius of the steel pipe 1 can be increased by setting the center of the radius at E situated on the center line $C_1$ of the heating coil 5 apart from the revolving center A of the scale S so as to obtain the bent pipe with a larger radius $R_1$ as shown in FIG. 5.

In order to obtain the bent steel pipe 1 with radius $R_1$, the scheduled bent values are prepared, for example, as shown in Table 3. Scheduled bent values are exhibited in the table, when a distance between the revolving center A and the bent initiating point D is set 200 mm and bent radius $R_1$ is set 500 mm. The scheduled bent values are increased as revolved angles θ are gradually incereased up to 90 degrees.

TABLE 3

| Revolved angle (θ) | Scheduled bent value (mm) |
|---|---|
| 0° | 0 |
| 10° | +9.8 |
| 20° | +24.4 |
| 30° | +44.3 |
| 40° | +70.5 |
| 50° | +103.9 |
| 60° | +145.0 |
| 70° | +193.7 |
| 80° | +249.2 |
| 90° | +309.1 |

Though not shown in figures, the center of the bending radius of the steel pipe 1 can be set on the extended center line $C_1$ at the same of the heating coil apart from the revolving center A. If the bending radius is gradually increased or decreased at the bending initiation point and ending point, fluctuation of the thickness of the bent pipe in the vicinity of these points can be made more moderate. In this case the bending procedure is executed in the same way as described above.

Embodiment 3

Figure 6:
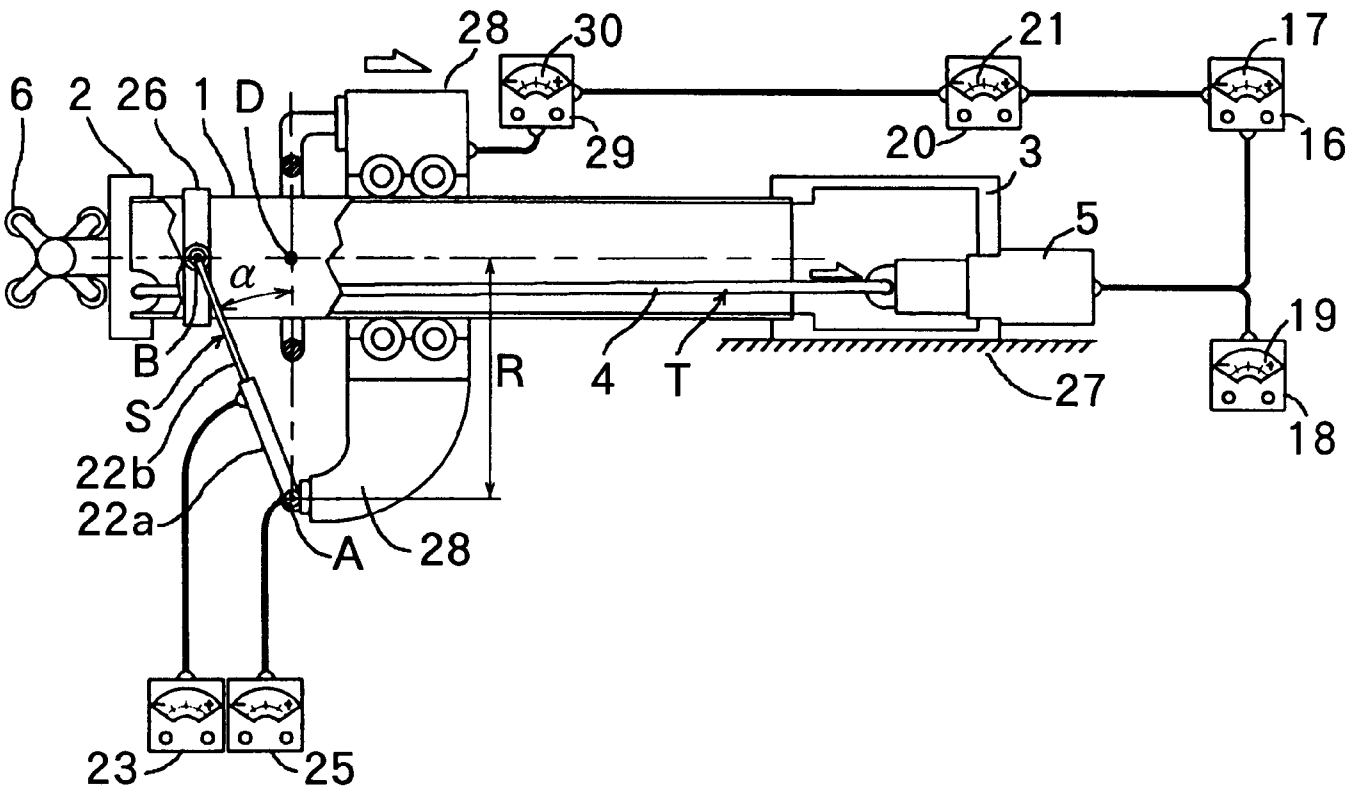
FIG. 6 is a plan view with a partial cutout of a pipe bending apparatus in the embodiment 3.

FIG. 6 illustrates other embodiment of the second apparatus. The embodiment of the second method is realized by the steel pipe bending apparatus in the embodiment 3.

In the above-mentioned the steel pipe bending apparatus in the embodiment 2 is constituted so as that the heating coil 10 is fixed and the steel pipe 1 is transferred. In the embodiment 3, on the other hand, the steel pipe bending apparatus is constituted so as that the steel pipe 1 is fixed and the heating coil is transferred along the steel pipe.

Namely, the bending apparatus is constituted such that the rear cramping plate 3 is fixed to a support 27 and the heating coil 10 is transferred by a coil transfer unit 28 along the steel pipe 1. A transfer velocity of the coil transfer unit 28 is controlled by a velocity regulator 29 of the unit referring displayed value on an indicator 30 of the transfer velocity. Other configuration is virtually the same as the embodiment 2. Also the bending procedure is carried out in the same way as in the embodiment 2.

Figure 7:
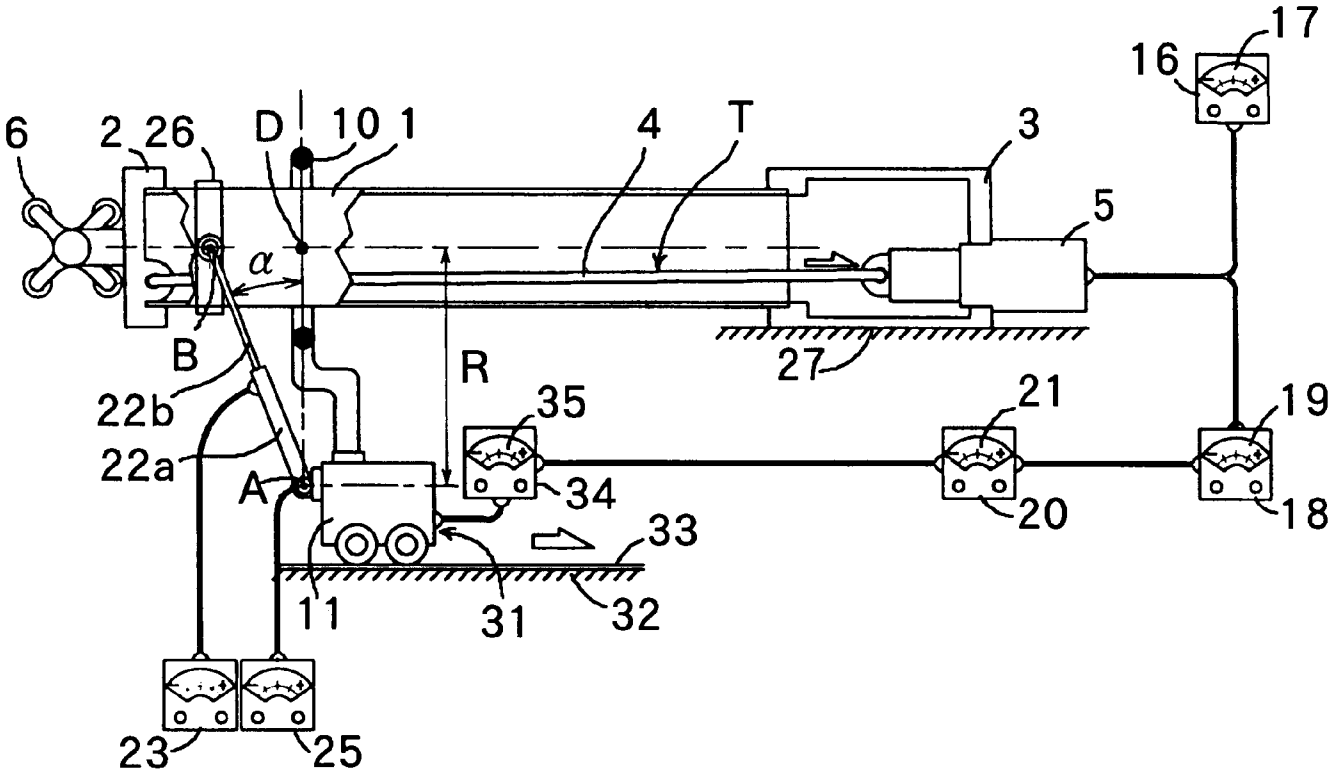
FIG. 7 is a plan view with a partial cutout of other pipe bending apparatus in the embodiment 3.

The above-mentioned coil transfer unit 28 transfers along the steel pipe 1, but the coil can be transferred by rollers fixed to the coil heating unit 11 such as a coil transfer unit 31 which transfers on a rail 33 fixed to a support 32 as shown in FIG. 7. In this case the transfer velocity of the coil transfer unit 31 controlled by a velocity regulator 34 with referring to a measured value displayed on a velocity indicator 35 of the coil transfer velocity. In this case the bending procedure is also executed in the same way as the embodiment 2.

Embodiment 4

Figure 8:
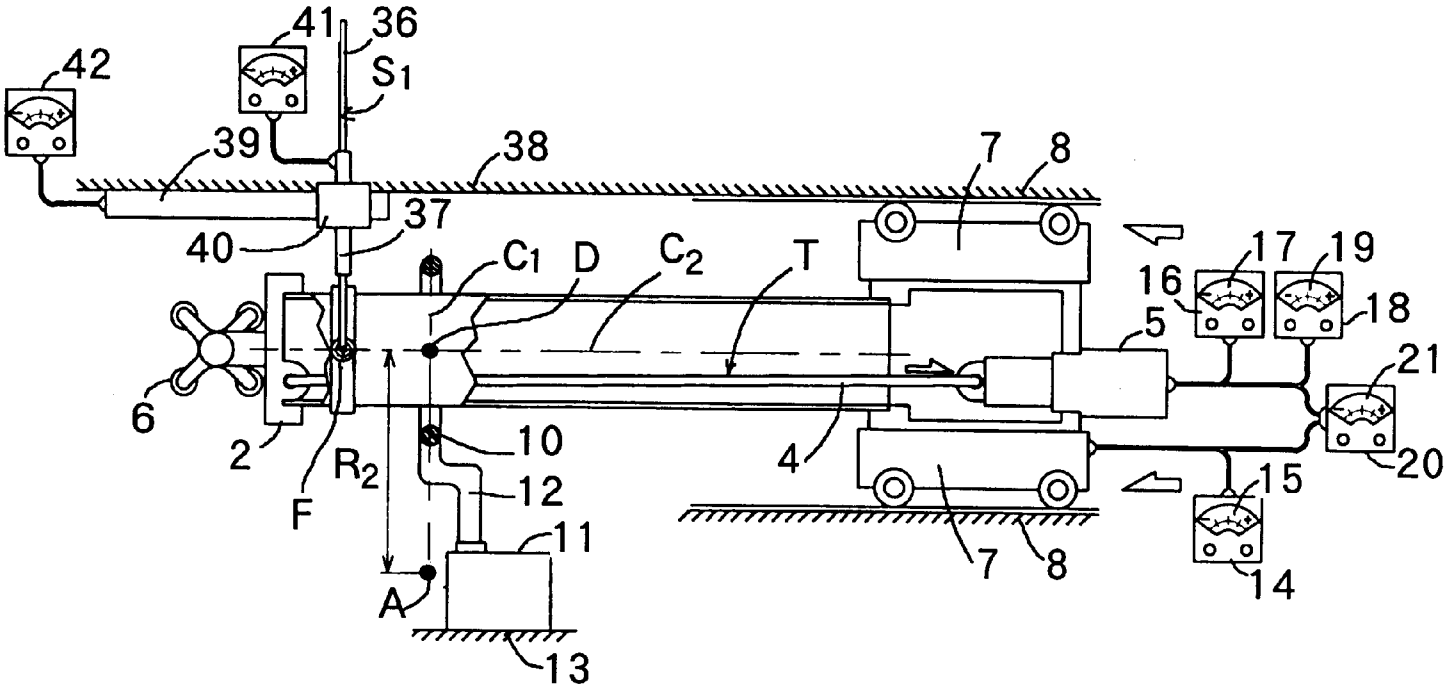
FIG. 8 is a plan view with a partial cutout of a pipe bending apparatus in the embodiment 4.
Figure 9:
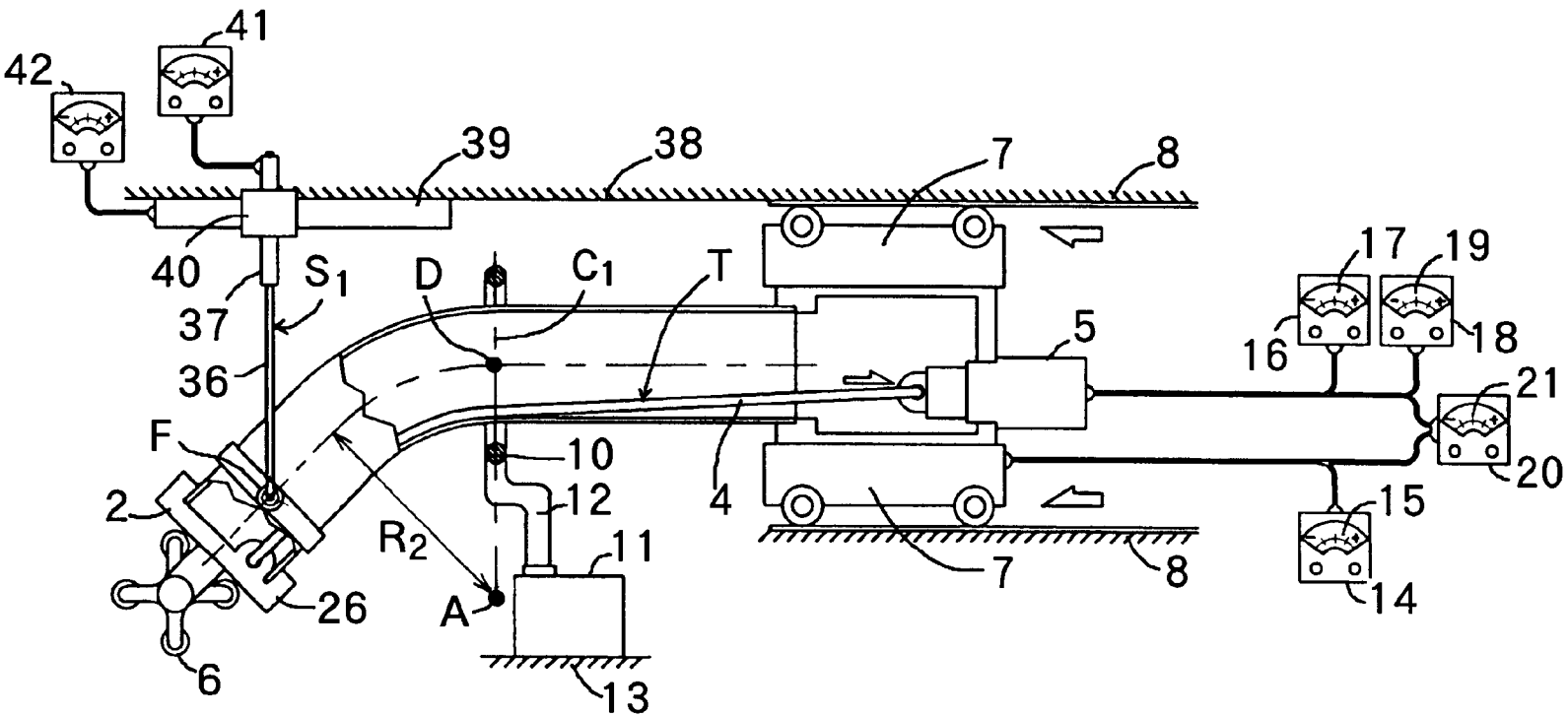
FIG. 9 shows a pipe bending movement of the pipe bending apparatus in the embodiment 4.
Figure 10:
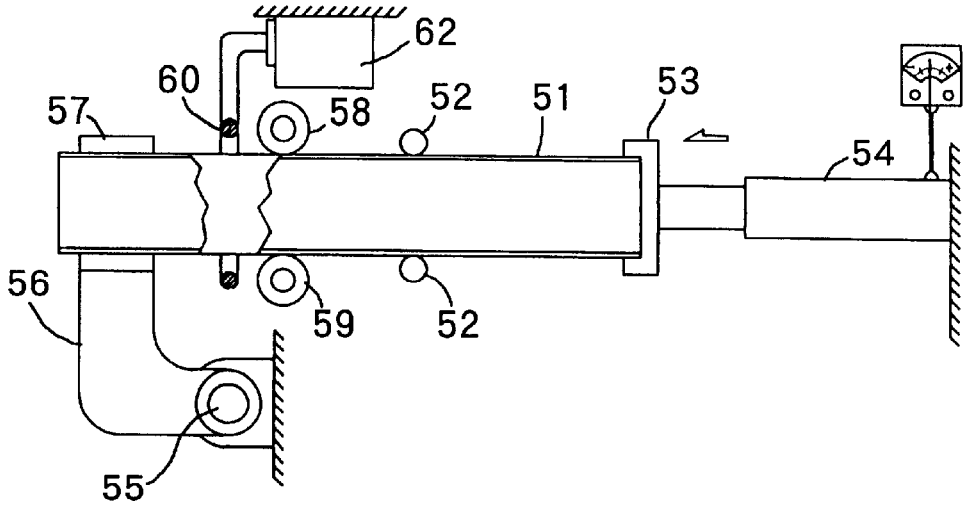
FIG.10 (PRIOR ART)
FIG. 10 is a plan view with a partial cutout of a conventional pipe bending apparatus.
Figure 11:
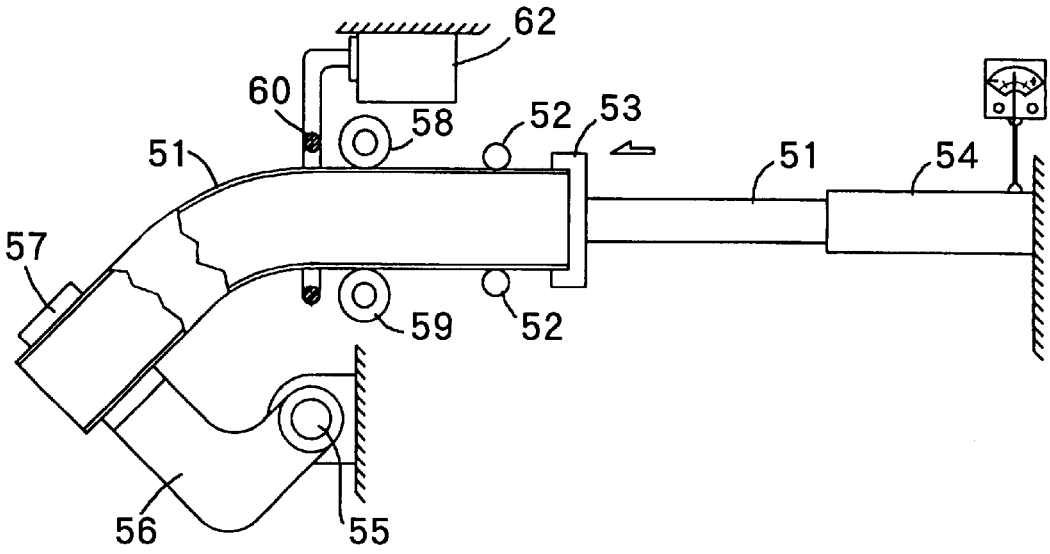
FIG.11 (PRIOR ART)
FIG. 11 shows a pipe bending movement of the conventional pipe bending apparatus.

FIG. 8 and FIG. 9 illustrate other embodiment of the second apparatus. The embodiment of the second method is realized by the steel pipe bending apparatus in the embodiment 4.

The pipe bending apparatus in the embodiment 4 employs an extendable scale $S_1$ in place of the scale S in FIG. 3. The other configuration is the same as the embodiment 2 as shown in FIG. 3.

One of the ends of a rod 36 constituting the scale $S_1$ is movably attached to the circular fitting 26 via a shaft F so as to revolve around the shaft, while one of the ends of a cylinder 37 is attached to a rail 39 mounted on a support 38 via a slider 40 so as to slide along the rail.

The rail 39 is fixed to the support 38 parallel to the axis $C_2$ of the steel pipe 1 the scale $S_1$ is attached to the rail 39 parallel to the center line $C_1$ of the heating coil.

The rail 39 in this embodiment is not constituted as a guide rail for scale $S_1$ during the bending procedure as shown in FIG. 9, but also as a measuring instrument to determine a transferred distance of the scale $S_1$.

An actual bent value in the embodiment 4 is expressed as an extended value of scale $S_1$ according to a transferred distance L of the scale $S_1$ along the rail 39 when the length of the scale $S_1$ before the bending procedure is set zero as shown in FIG. 8.

The extended value of the scale $S_1$ is displayed on an indicator 41. The transferred distance L of the scale $S_1$, determined by the measuring instrument (rail) 39, is displayed on an indicator 42 to display the transferred distance.

By employing the steel bending apparatus with the above-mentioned constitution where a bending radius $R_2$ is set as a distance between a center point A on the extended center line $C_1$ and the initiation point D of the bending on the steel pipe 1, a 90 degree bending of the steel pipe 1 is executed as follows.

(1) A bending schedule table as shown in Table 4 where a length of the scale $S_1$ is given in relation to a transferred distance L of the scale $S_1$ is prepared beforehand. In this Table scheduled bent values are exhibited when the bending radius is set 500 mm. The length of the scale $S_1$ in relation to the transferred distance L means the scheduled bending value expressed in mm of the steel pipe 1 when the length of the scale $S_1$ is set zero before the bending.

TABLE 4

| Transferred distance L (mm) | Scheduled bent value (mm) |
|---|---|
| 0 | 0 |
| 33.6 | 15.7 |
| 64.0 | 37.0 |
| 90.2 | 63.7 |
| 111.5 | 93.6 |
| 127.2 | 127.2 |
| 136.8 | 163.0 |
| 140.0 | 200.0 |
| 136.8 | 237.0 |
| 127.2 | 272.8 |

(2) The steel pipe 1 is successively bent by driving the steel pipe transfer unit 7 so as to transfer the steel pipe forward and applying the tensile force to the chain 4 from the hydraulic jack 5 with referring to the table, in the same way as the embodiment 1. The steel pipe 1 is continuously bent at the heating portion t that successively transfers backward receiving compression force in the direction of the eccentric axis line of the pipe.

(3) During the bending procedure, if the actual bent values displayed on the indicator 41 are, for example, values in Table 5, the above-mentioned tensile velocity V1 of the hydraulic jack 5 and the transfer velocity V2 of the steel pipe transfer unit 7 are controlled so as that the actual bent values attain the same values as scheduled ones.

TABLE 5

| Transferred Distance L (mm) | Scheduled Bent value (mm) | Actual bent Value (mm) | Difference (mm) |
|---|---|---|---|
| 0 | 0 | 0 | 0 |
| 33.6 | 15.7 | 17 | +1.3 |
| 64.0 | 37.0 | 35 | −2.0 |
| 90.2 | 63.2 | 65 | +1.8 |
| 111.5 | 93.6 | 95 | +1.4 |
| 127.2 | 127.2 | 125 | −2.2 |
| 136.8 | 163.0 | 164 | +1.0 |
| 140.0 | 200.0 | 198 | −2.0 |
| 136.8 | 237.0 | 239 | +2.0 |
| 127.2 | 272.8 | 273 | +0.2 |

For example, if the difference is +1.3, namely, it means the actual bent amount is less than the scheduled one, either a measure to increase the tensile velocity V1, a measure to decrease the transfer velocity V2 or a measure to increase the ratio (V1/V2) is employed. If the difference is −2.0, namely it means the actual bent is more than the scheduled one, the opposite controlling measure is taken.

The bending schedules in the embodiments 2 to 4 mentioned above can be stored in recording media as computer programs so as to execute computer controlled bending procedures.

As explained, above-mentioned constitutions according to the present invention attain, the following effects.

(1) The bending procedure of the steel pipes can be executed on construction sites in accordance with a progress of the construction, since the present invention realizes a small sized, lightweight and portable steel pipe bending apparatus.

(2) Thinning thickness of the steel pipe during the bending procedure can be kept to a lower extent, since the compression force is applied in the longitudinal direction of the steel pipe by the tensile force applying means.

(3) Bending accuracy of the steel pipe can be improved, since the bending amount of the steel pipe is controlled successively and stepwise.

What is claimed is:

1. An apparatus of steel pipe bending comprises; a heating means to heat said steel pipe circularly around a center axis of said pipe, a cooling means to cool said heated portion of said steel pipe circularly around said center axis of said pipe, a tensile force applying means to apply said tensile force on points of application which are located in the opposite directions from said circularly heated portion, a variable controlling means to control said tensile force variably, a transfer means to transfer relatively said steel pipe and said heating means and said cooling means in a direction of said axis of said steel pipe a controlling means to control said relative transfer velocity and a scale to measure bent values stepwise.

2. An apparatus of steel pipe bending comprises; a heating means to heat said steel pipe circularly around a center axis of the pipe, a cooling means to cool said heated portion of said pipe circularly around said center axis of said pipe, a tensile force applying means to apply said tensile force on points of application which are located in the opposite directions from said circularly heated portion, a variable controlling means to control said tensile force variably, a transfer means to transfer relatively said steel pipe and said heating means and said cooling means in a direction of said axis of said steel pipe, a controlling means to control said relative transfer velocity and a scale to measure bent values stepwise according to a predetermined bending schedule so as to control said relative transfer velocity.

3. A method of steel pipe bending comprises; forming a locally heated circular portion around a center axis of said steel pipe, relatively transferring said locally heated portion and said steel pipe in a direction of said center axis of said steel pipe and controlling said relative transfer velocity of said heated portion and said steel pipe during said bending procedure by applying a tensile force between two points of application which are located in the opposite directions from said heated portion along an eccentric axis of said steel pipe based on the measured bent value.

4. A method of steel pipe bending comprises; forming a locally heated circular portion around a center axis of said steel pipe, relatively transferring said locally heated portion and said steel pipe in a direction of said center axis of said steel pipe, measuring actual bent values stepwise during a successive bending procedure according to a bending schedule where stepwise bent values are predetermined stepwise and controlling said relative transfer velocity of said heated portion and said steel pipe during said bending procedure by applying a tensile force between two points of application which are located in the opposite directions from said heated portion along an eccentric axis of said steel pipe according to a difference between said predetermined bent value and said actual bent value so as to control said tensile force.

* * * * *